US006396902B2

(12) United States Patent
Tybinkowski et al.

(10) Patent No.: US 6,396,902 B2
(45) Date of Patent: May 28, 2002

(54) X-RAY COLLIMATOR

(75) Inventors: Andrew P. Tybinkowski, Boxford; Michael J. Duffy, Methuen; Lidia Nemirovsky, Salem, all of MA (US); Eric M. Bailey, Hampstead, NH (US)

(73) Assignee: Analogic Corporation, Peabody, MA (US)

( * ) Notice: Subject to any disclaimer, the term of this patent is extended or adjusted under 35 U.S.C. 154(b) by 0 days.

(21) Appl. No.: 09/766,373

(22) Filed: Jan. 19, 2001

Related U.S. Application Data

(60) Provisional application No. 60/221,739, filed on Jul. 31, 2000.

(51) Int. Cl.[7] ..... G21K 1/04

(52) U.S. Cl. ..... 378/150; 378/148; 378/149

(58) Field of Search ..... 378/19, 147, 149–150, 378/151, 153, 148; 359/641, 894; 250/363.1; 74/440, 443

(56) References Cited

U.S. PATENT DOCUMENTS

| | | | | |
|---|---|---|---|---|
| 4,277,685 A | | 7/1981 | Covic et al. | 250/445 |
| 4,466,112 A | | 8/1984 | Covic et al. | 378/7 |
| 4,788,699 A | * | 11/1988 | Dobert et al. | 378/38 |
| 4,920,552 A | | 4/1990 | Hermens | 378/153 |
| 4,991,189 A | | 2/1991 | Boomgaarden et al. | 378/4 |
| 5,299,250 A | | 3/1994 | Styrnol et al. | 378/19 |
| 5,400,672 A | * | 3/1995 | Bunch, Jr. | 74/409 |
| 5,550,886 A | | 8/1996 | Dobbs et al. | 378/19 |
| 5,563,924 A | | 10/1996 | Winkelmann | 378/150 |
| 5,644,614 A | | 7/1997 | Toth et al. | 378/147 |
| 5,684,854 A | | 11/1997 | Hughes | 378/206 |
| 5,799,057 A | | 8/1998 | Hoffman et al. | 378/147 |

* cited by examiner

*Primary Examiner*—Robert H. Kim
*Assistant Examiner*—Jurie Yun
(74) *Attorney, Agent, or Firm*—McDermott, Will & Emery

(57) ABSTRACT

A collimator having slits of varied widths, wherein each slit includes a curved side profile having a common axis of curvature for providing a cross-section of an emitted beam of energy with a substantially uniform width when the common axis of curvature of the slit intersects a focal spot of a source of the beam. The collimator is curved about a rotation axis substantially normal to the common axis of curvature, such that rotating the collimator about the rotation axis will sequentially position the slits to collimate the emitted beam.

25 Claims, 6 Drawing Sheets

X-RAY COLLIMATOR

This application claims benefit of Prov. No. 60/221,739 filed Jul. 31, 2000.

FIELD OF DISCLOSURE

The present disclosure relates to the field of radiography and, in particular, relates to computer tomography scanners. Even more particularly, the present disclosure relates to a collimator and a collimator assembly for use with a computer tomography scanner.

BACKGROUND OF DISCLOSURE

In computed tomography, a patient to be examined is positioned in a scan circle of a computer tomography scanner. A shaped x-ray beam is then projected from an x-ray source through the scan circle and the patient, to an array of radiation detectors. By rotating the x-ray source and the collimator relative to the patient (about a z-axis of the scanner), radiation is projected through an imaged portion of the patient to the detectors from a multiplicity of directions. From data provided by the detectors, an image of the scanned portion of the patient is constructed.

Within the x-ray source, an electron beam strikes a focal spot point or line on an anode, and x-rays are generated at the focal spot and emitted along diverging linear paths in an x-ray beam. A collimator is employed for shaping a cross-section of the x-ray beam, and for directing the shaped beam through the patient and toward the detector array.

Conventional collimators generally comprise a flat plate with a rectangular slit of uniform width for producing a rectangular beam cross-section, as desired with systems employing a rectangular detector array. The conventional collimator design is problematic, however, since the actual cross-sectional shape of the beam produced by the collimator is not precisely rectangular but is instead wider at its center than at its ends, i.e., convex. The convex beam cross-section may extend beyond a desired row of detectors and irradiate adjacent rows of detectors. In addition, the convex beam cross-section may subject a patient to a dose of x-rays in excess of those required for the scan.

Conventional collimators produce such convex beam cross-sections because of the variation in distance between the focal spot of the x-ray source and different portions of the flat slit of the collimator through which the beam passes. An example of a convex beam cross-section produced by such conventional collimators is illustrated in FIGS. 1 and 2.

In a conventional computed tomography scanner 1, as represented in FIGS. 1 and 2, an x-ray source 2 projects a beam 4 from a focal spot 3, through a slit 12 in a collimator 10. The resulting cross-section 6 of the beam 4, as incident on a detector array 8 for example, is wider slightly in its center portion 7*a,* as compared to end portions 7*b* of the beam cross-section 6.

More particularly, the center portion 7*a* of the beam cross-section 6 has a width $w_1$ that is wider than a width $w_2$ of each of the end portions 7*b*. This results because a distance $d_1$ between the focal spot 3 and a center portion 14*a* of the slit 12 is greater than a distance $d_2$ between the focal spot 6 and end portions 14*b* of the slit 12. As shown in FIG. 2, if the widths $w_2$ of the end portions 7*b* of the beam cross-section 6 are matched to the widths W of end detectors 9*b* of the detector array 8, then the width $w_1$ of the center portion 7*a* of the beam cross-section 6 extends beyond the width W of centrally located detectors 9*a* of the detector array 8. A patient being scanned, therefore, may be subject to an unnecessary radiation dose since the portion of the beam cross-section extending beyond the detectors is unused.

Another problem associated with conventional computer tomography scanners arises due to component movement, or drifting, that occurs during operation of the scanners. Control of these movements can be critical since accurate image generation through computer tomography scanning assumes that the components of the system, especially the focal spot, collimator and detectors, always remain perfectly aligned relative to one another during a scan, and from scan to scan. Consequently, any movement of the various tomography components during a scan can cause major inaccuracies in reconstructed images.

One particular cause of unwanted movement is the beam source itself. For example, as the anode of the beam source heats up during operation, thermal expansion causes the focal spot to shift, thus causing the resulting x-ray beam to shift with respect to the collimator. Typically, the focal spot will drift in a direction parallel to the z-axis of the scanner. The focal spot shifting can detract from the integrity of the image data and can cause major inaccuracies in the reconstructed image.

What is desired, therefore, is a collimator that produces a beam cross-section having a uniform width. What is also desired is a collimator assembly providing a plurality of collimator slits of varied widths for selective alignment between a focal point and a detector array of a computer tomography scanner.

What is additionally needed and desired is a collimator assembly that compensates for shifting of a focal point of a computer tomography scanner during a scanning procedure, to ensure proper alignment of a collimator of the assembly with the focal spot.

SUMMARY OF THE DISCLOSURE

The present disclosure is directed to a collimator and collimator assembly that address and overcome the limitations of conventional collimators and computer tomography scanners. In particular, the present disclosure provides a collimator including a plurality of slits that each have a uniform width and are each curved about a common axis of curvature for producing a beam cross-section of a substantially uniform width. In addition, the slit widths are varied from one another for producing beam cross-sections of varied widths. Furthermore, the collimator is shaped so that the slits can be sequentially aligned with a focal point of a computer tomography scanner by rotating the collimator about a rotation axis normal to the axis of curvature.

The present disclosure also provides an assembly for selecting one of the slits of the collimator. The assembly includes a selection motor having a rotatable shaft, and a gear mechanism coupling the motor shaft to the collimator for rotating the collimator about its rotation axis to select a slit. According to one aspect, a resilient material is seated in a circumferential groove of at least one gear of the gear mechanism for absorbing shock. According to another aspect, an index pin is provided for receipt in an index aperture of the gear mechanism for fine tuning and locking the rotated position of the collimator.

The present disclosure additionally provides an assembly that realigns the collimator with a shifting focal point of a computer tomography scanner during a scanning procedure, to ensure proper alignment of the collimator and the focal point. The assembly includes an alignment motor having a rotatable shaft, a cam fixed to the motor shaft for rotation therewith, and a follower rotatably and slidingly received on the motor shaft and operatively contacting the cam for axial movement of the follower along the shaft upon rotation of the cam. The collimator is operatively coupled to the follower for movement of the collimator in a direction parallel to the shaft of the motor upon movement of the follower. Preferably, the alignment motor is oriented such that the collimator moves parallel to a z-axis of a scanner. According to one aspect, the assembly includes a spring biasing the collimator toward the alignment motor.

BRIEF DESCRIPTION OF THE DRAWINGS

The foregoing and other features and advantages of the present disclosure will become more apparent from the detailed description of the disclosure, as illustrated in the accompanying drawing figures wherein.

DETAILED DESCRIPTION OF DISCLOSURE

Figure 3:
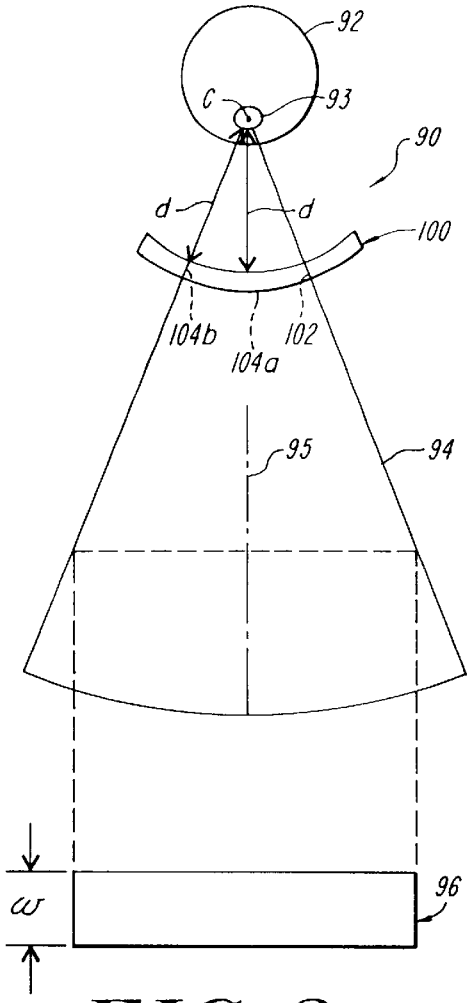
FIG. 3 is an elevation end view of a collimator according to the present disclosure shown shaping a beam of energy.
Figure 4:
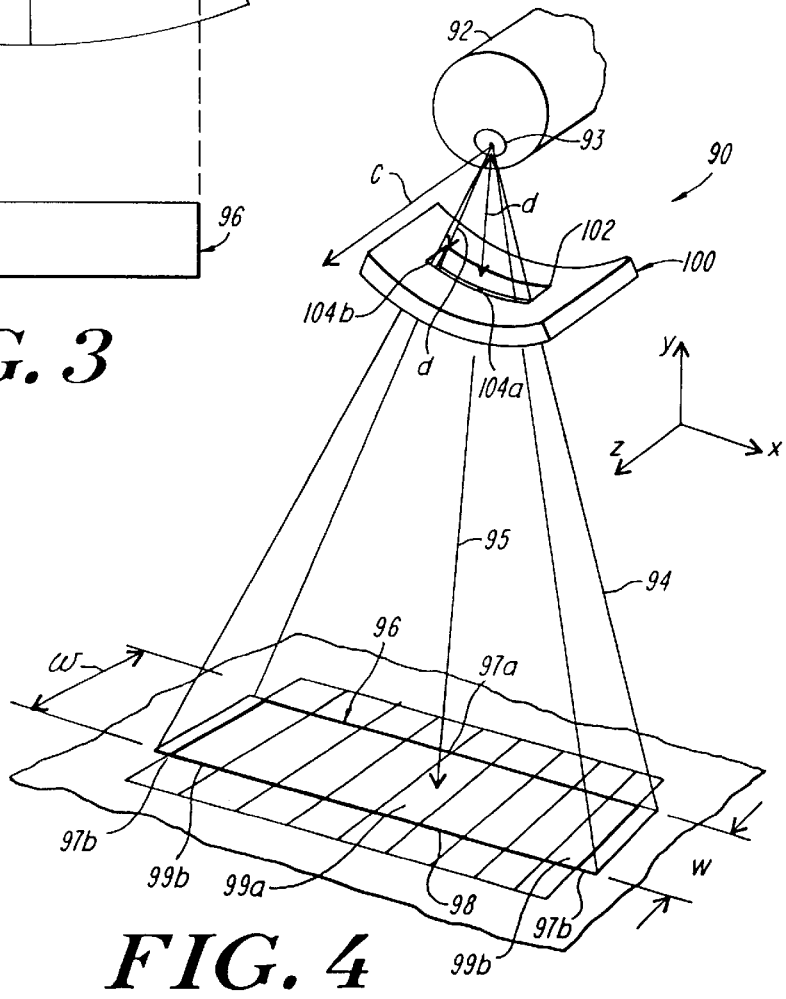
FIG. 4 is a perspective view of the collimator and beam of FIG. 3.

Referring first to FIGS. 3 and 4, in computed tomography, a patient (not shown) to be examined is positioned in a scan circle of a computer tomography scanner 90, parallel with a z-axis, and between an x-ray source 92 and a rectangular detector array 98. The x-ray source 92 then projects a beam of energy, or x-rays 94 from a focal spot 93, through the patient, to the detector array 98. By rotating the x-ray source 92 about the z-axis and relative to the patient, radiation is projected through a portion of the patient to the detector array 98 from a many different directions around the patient. An image of the scanned portion of the patient then is constructed from data provided by the detector array 98, which has a uniform width W.

Figure 1:
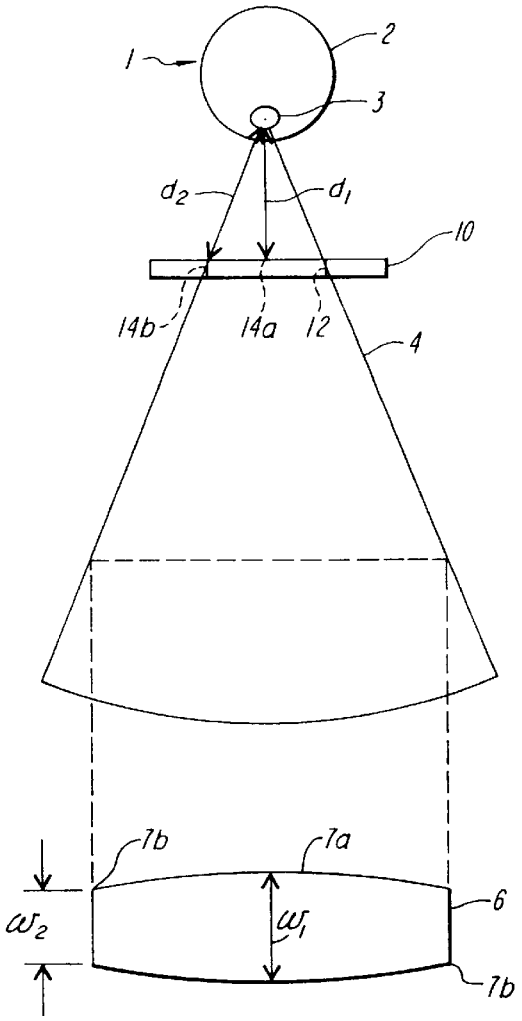
FIG. 1 (PRIOR ART)
FIG. 1 is an elevation end view of a collimator of the prior art shown shaping a beam of energy.
Figure 2:
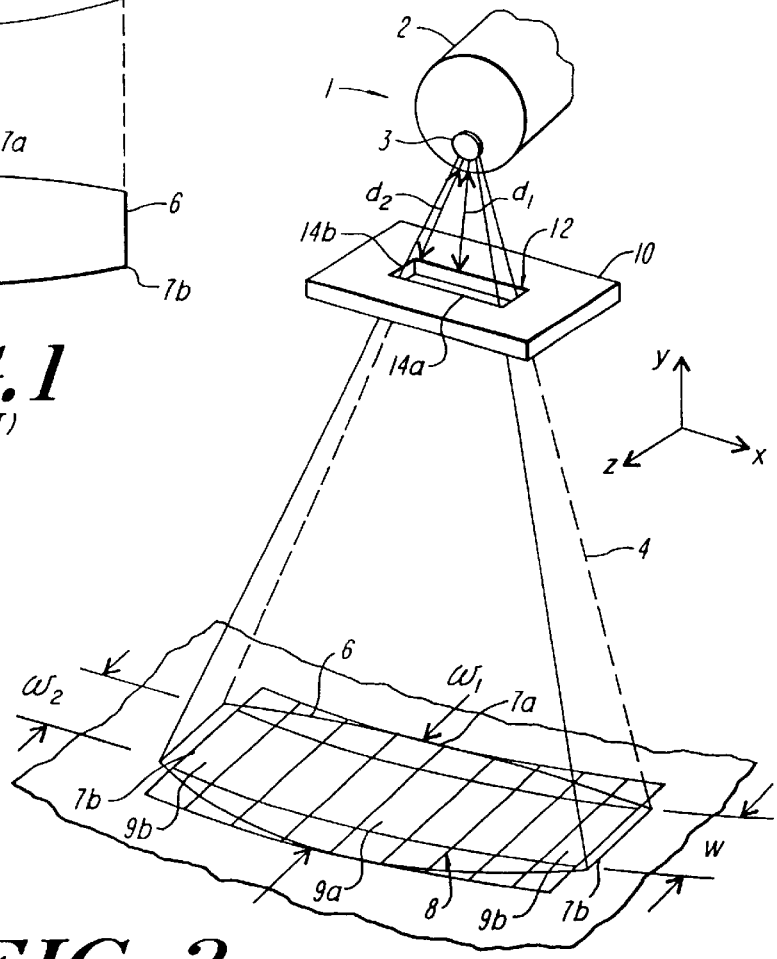
FIG. 2 (PRIOR ART)
FIG. 2 is a perspective view of the collimator and beam of FIG. 1.

The scanner 90 of FIGS. 3 and 4 employs a collimator 100 constructed in accordance with the present disclosure. The collimator is shown in greater detail in FIGS. 5–7, wherein like reference characters refer to the same parts throughout the different views. A slit 102 of the collimator 100 shapes the cross-section 96 of the beam 94 into a rectangular shape of substantially uniform width w, as desired in a scanner 90 employing a rectangular detector array 98. In particular, the widths w of end portions 97*b* of the beam cross-section 96 are equal to the width w of a center portion 97*a* of the beam cross-section 96. Accordingly, the end portions 97*b* of the beam cross-section 96 can be matched to the width W of end detectors 99*b* of the detector array 98, and the width w of the center portion 97*a* of the beam cross-section 96 will not be wider than the width W of centrally located detectors 99*a* of the detector array 98. This contrasts with the non-uniform widths $w_1$, $w_2$ of the beam cross-section 12 provided by the prior art collimator 10 previously described and shown in FIGS. 1–2.

Figure 6:
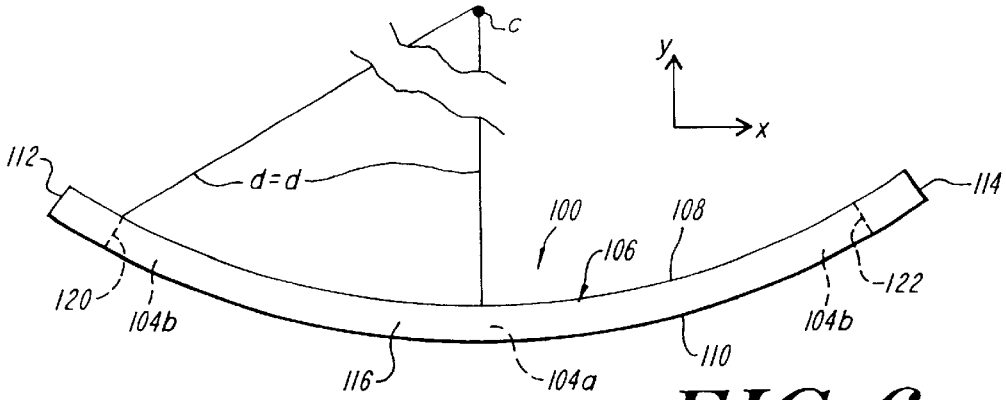

As can be seen best in the end elevation views of FIGS. 3 and 6, a plate-like body 106 of the collimator 100 is curved about a common axis of curvature C. Preferably, the plate-like body 106 is curved symmetrically about the common axis of curvature C. The elongated slit 102 is oriented on the curved body 106 so that a side profile of the slit is also curved and shares the common axis of curvature C of the collimator. All points of the collimator 100 and all points of the slit 102 are equally spaced from the common axis of curvature C by a distance d.

When the collimator 100 is positioned with respect to the x-ray source 92 so that the axis of curvature C of the collimator intersects the focal spot 93, and so that a central portion 104*a* of the slit 102 intercepts an axis 95 of the beam 94, as shown in FIGS. 3 and 4, all points of the slit 102 are then equally spaced from the focal spot 93. For example, the distance d between the focal spot 93 and an end portion 104b of the slit 102 is substantially similar to the distance d between the focal spot 93 and the central portion 104*a* of the slit. In this manner, the emitted beam 94 passing through the slit 102 of the collimator 100 has a cross-section 96 that is of substantially uniform width w throughout, as shown in FIGS. 3 and 4.

Accordingly, when the common axis of curvature C of the presently disclosed collimator 100 intersects the focal spot 93 of the scanner 90, as shown in FIG. 4, the collimator 100 provides a rectangular beam cross-section 96 of uniform width w that closely aligns with the detector array 98: including both centrally located detectors 99*a* and end detectors 99*b*. This in contrast to the prior art collimator 10 of FIG. 2, wherein the central portions 7*a* of the beam cross-section 6 extend beyond the intended row of detectors 9*a*.

Figure 5:
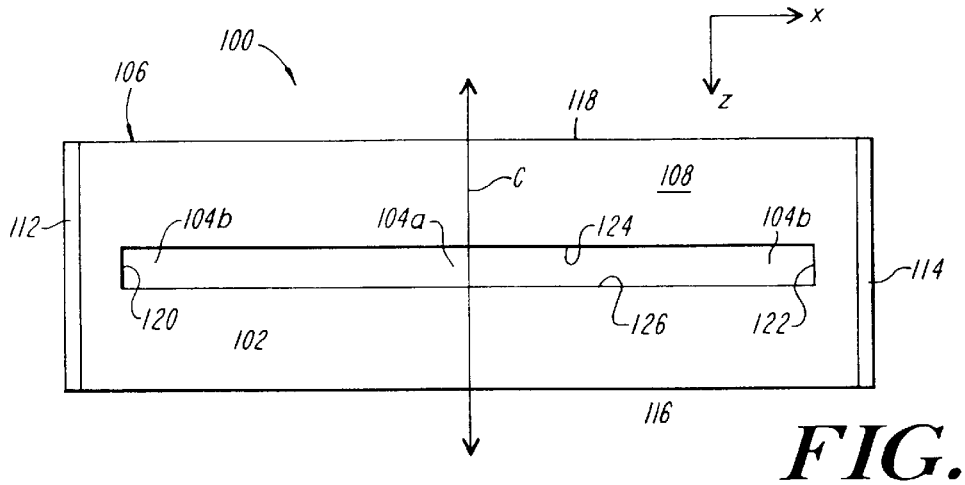
FIGS. 5, 6 and 7 are top plan, end elevation, and perspective views, respectively, of the collimator of FIGS. 3 and 4.
Figure 7:
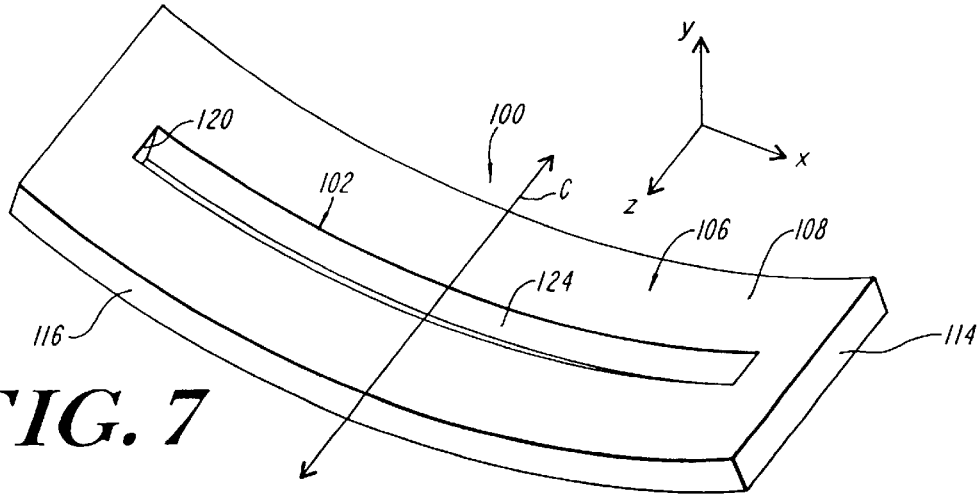

Referring to FIGS. 5–7, the plate-like body 106 of the collimator has a uniform thickness and a generally rectangular shape (as viewed from above). As shown, the plate-like body 106 includes a top and a bottom 108, 110, outwardly facing sides 112, 114, and outwardly facing ends 116, 118. The plate-like body 106 also includes the elongated slit 102, which extends between the top and bottom 108, 110 and is parallel with the ends 116, 118. As shown in FIGS. 5–7, inwardly facing, opposed sides 120, 122, and inwardly facing, opposed elongated ends 124, 126 of the body 106 define the elongated slit 102. The inwardly facing sides 120, 122 are parallel and the inwardly facing ends 124, 126 are parallel.

Figure 8:
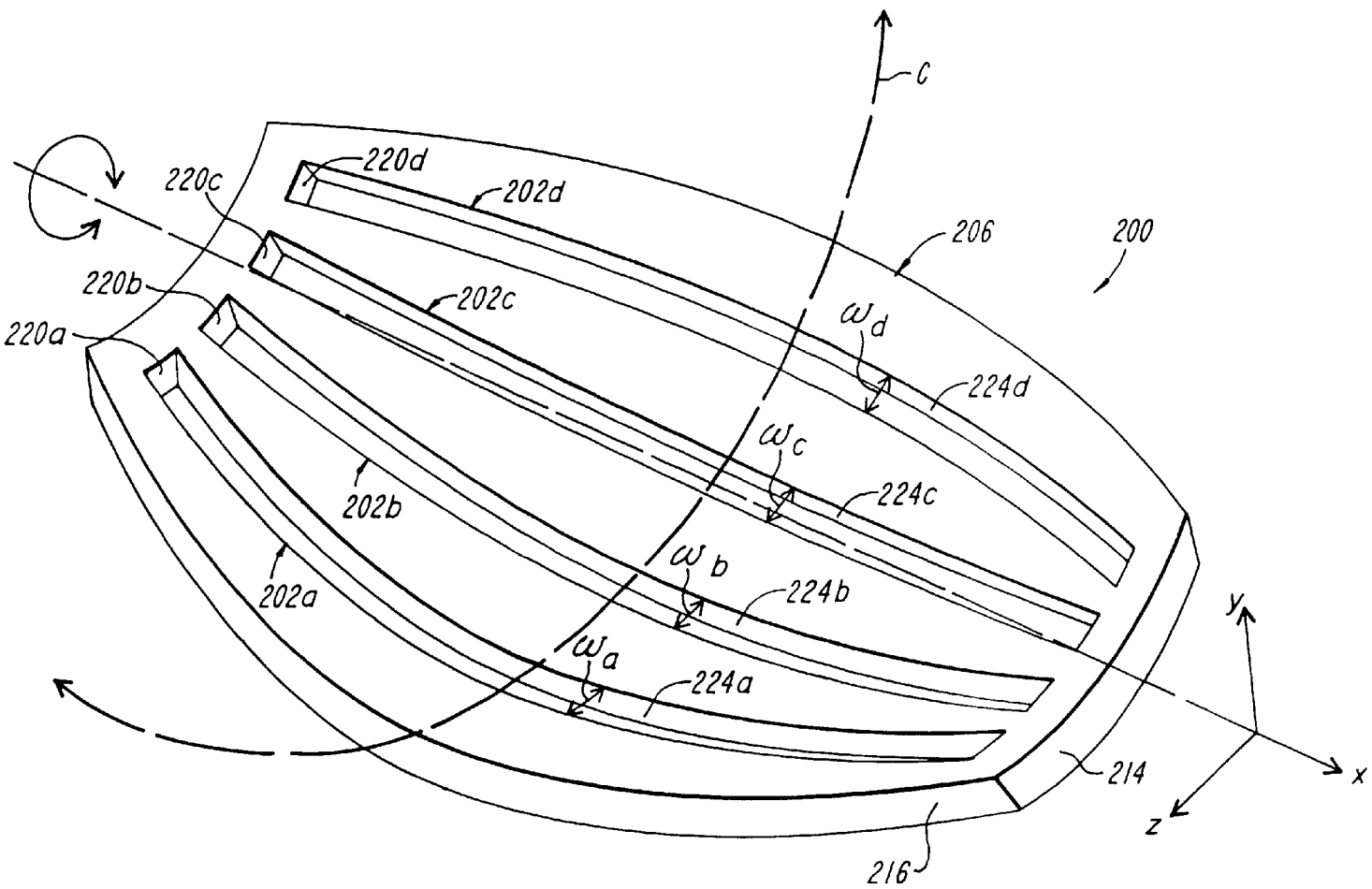
FIG. 8 is a perspective view of another collimator according to the present disclosure.

Referring to FIG. 8 another collimator 200 constructed in accordance with the present disclosure is shown. The collimator 200 adds the benefit of having a plurality of slits 202*a–d* for producing beam cross-sections of different, uniform widths, and is configured so that one of the slits 202*a–d* can be selected for use by rotation of the collimator about a longitudinal axis.

The collimator 200 shown in FIG. 8 is similar to the collimator 100 shown in FIGS. 3–7, and parts of the collimator 200 of FIG. 8 that are similar to parts of the collimator 100 of FIGS. 3–7 have the same reference numerals preceded by a "2". The collimator 200 includes a plate-like body 206 that is also curved so that the collimator has a common axis of curvature C.

Instead of a single slit, however, the collimator 200 has a plurality of elongated slits 202*a–d,* wherein each slit has a varied, but uniform, width $w_a$–$w_d$. The collimator 200 allows the selection of a beam cross-section of a varied, but uniform, width. The slits 202*a–d* extend between a top and a bottom 208, 210 of the body 206 and are parallel with outwardly facing ends 216, 218. Inwardly facing sides 220*a–d,* 222*a–d,* and inwardly facing ends 224*a–d,* 226*a–d* of the body 206 define the elongated slits 202*a–d.* The inwardly facing, elongated ends 224*a–d,* 226*a–d* of each slit 202*a-d* are parallel such that each slit has a uniform width $w_a$–$w_d$. In addition, each of the elongated slits 202*a–d* shares the common axis of curvature C of the collimator 200. When the common axis of curvature C intersects the focal spot of the scanner, the plurality of elongated slits 202*a–d* produce beam cross-sections of varied, but uniform, widths.

In addition to being curved about the common axis of curvature C, the body 202 of the collimator 200, and thus the axis of curvature C, are also curved about a rotation axis that is normal to the common axis of curvature. In the embodiment of the collimator 200 of FIG. 8, the rotation axis happens to coincide with the x-axis, as shown. One of the plurality of slits 202*a–d* is selected by rotating the collimator 200 about the rotation axis until the central portion of the preferred slit intercepts the axis of the beam and the portion of the common axis of curvature C directly above the preferred slit is aligned with the focal spot. The slits 202*a–d* are selectable according to a desired beam width, for example, in computed tomography scanners that allow for flexibility in the number and thickness of slices acquired during a scan. In this manner, the resulting collimated beam is adapted for irradiating a particular row of detectors, or groups of rows of detectors, without irradiating adjacent rows of detectors not utilized for that scan.

Figure 9:
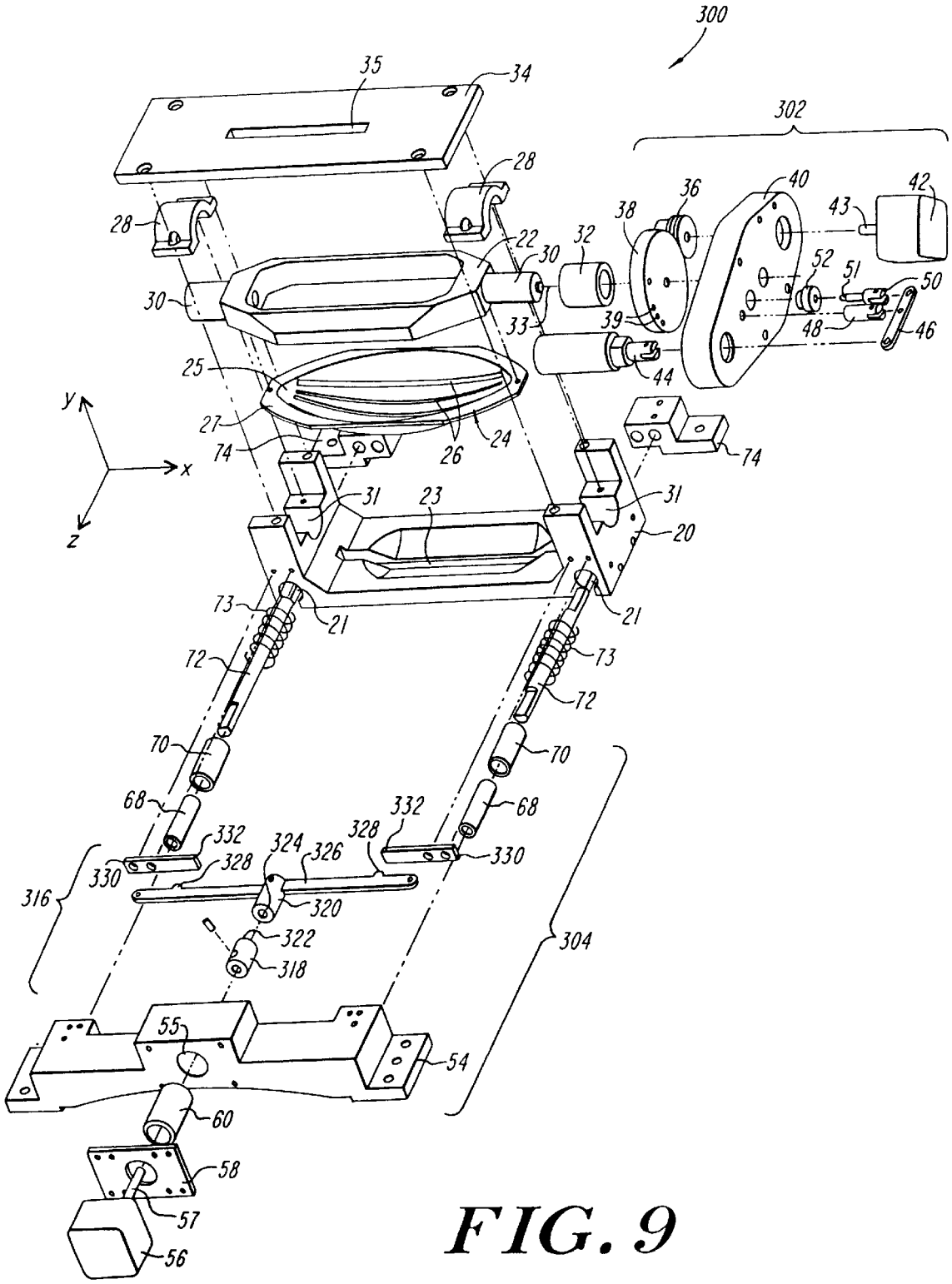
FIG. 9 is an exploded perspective view of a collimator assembly according to the present disclosure.

Referring now to FIG. 9, a collimator assembly 300 according to the present disclosure for use with a computed tomography scanner is shown. The assembly 300 is for mounting in a scanner (not shown) adjacent a beam source, and between a focal spot of the beam source and a detector array of the scanner. The assembly 300 collimates an emitted beam of energy from the focal spot and directing the collimated beam to the detectors.

In general, the assembly 300 includes a collimator 24 having a plurality of slits 26 that allows for the selection of a preferred beam width. The assembly 300 also includes means for selecting 302 one of the collimator slits 26, and means for shifting 304 the collimator 24 to compensate for shifting of a focal spot of a scanner incorporating the assembly.

The collimator assembly 300 includes a collimator 24 fixed to a mounting bracket 22. The collimator 24 is similar to the collimator 200 of FIG. 8, and includes a plate-like body 25 that is curved so that the body has a common axis of curvature. The collimator 24 has a plurality of elongated slits 26 of varied, but uniform, widths for producing beam cross-sections of varied, but uniform, widths. The body 25 is also curved about a rotation axis that is normal to the common axis of curvature, such that one of the plurality of slits 26 is selected by rotating the collimator 24 about the rotation axis. The collimator 24 includes a mounting flange 27 extending from an outer periphery of the body 25 for securing the collimator to the mounting bracket 22.

The mounting bracket 22 includes first and second shafts 30 on each end of a longitudinal axis 33 that are rotatably received in seats 31 of a base 20. Shaft clamps 28 secure the mounting bracket 22 to the base 20, and bushings 32 allow for rotational movement of the bracket and attached collimator 24 relative to the base 20 about the longitudinal axis 33 of the bracket. Although not shown, the collimator 24 and the mounting bracket 22 are adapted such that the rotation axis of the collimator coincides with the longitudinal axis 33 of the bracket. The assembly 300 is constructed for mounting in a scanner such that the longitudinal axis 33 of the bracket 22 will be parallel to the x-axis of the scanner.

A cover 34 is secured to the base 20 over the mounting bracket 22 and the collimator 24. The cover 34 includes an elongated aperture 35 for allowing an emitted beam of energy from a focal point of a beam source to be directed through the collimator 24. An elongated aperture 23 in the base 20 allows the collimated beam to then pass out of the collimator assembly 600 to be directed towards an array of beam detectors of a computer tomography scanner, for example. Selecting one of the plurality of slits 26 of the collimator 24 by rotating the mounting bracket 22 about the longitudinal axis 33, therefore, aligns the selected collimator slit with both the aperture 35 of the cover 34 and the aperture 23 of the base 20. A collimated beam of a preferred uniform width can then be emitted through the assembly 300.

The assembly 300 additionally includes means for selecting 302 a particular slit 26 of the collimator 24 for operation. Preferably, the means for selecting 302 comprises a "selection" motor 42 having a rotatable shaft 43 coupled to the collimator mounting bracket 22 through a gear mechanism. The gear mechanism preferably comprises a drive gear 36 fixed to the shaft 43 of the motor 42 for rotation therewith, and meshed to a driven gear 38 fixed to the shaft 30 of the collimator mounting bracket 22 for rotation therewith. Rotation of the motor shaft 42, accordingly, results in rotation of the collimator 24.

The selection motor 42 preferably comprises a stepping motor controlled by a controller (not shown) having a counter for calculating which of the plurality of slits 26 of the collimator 24 is aligned with the aperture 35 of the cover 34 based upon the stepped rotation of the motor. A suitable controller and counter combination is shown for example in U.S. Pat. No. 5,550,886 to Dobbs et al. entitled "X-ray Focal Spot Movement Compensation System", which is assigned to the assignee of the present disclosure and which is incorporated herein by reference in its entirety.

Figure 10:
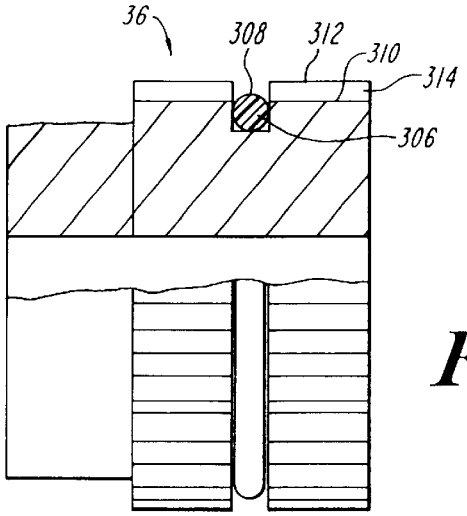
FIG. 10 is an elevation end view, partially in section, of a gear according to the present disclosure for use as part of the collimator assembly of FIG. 9.

Referring also to FIG. 10, at least one of the gears 36, 38 includes a circumferential groove 306 receiving a ring of resilient material 308, such as rubber, for providing a "shock absorber" between the gears. The ring of resilient material 308 serves to reduce or eliminate backlash, or play, in the motion of the interlocking gear teeth of the gears 36, 38, and further serves to mitigate noise during gear motion. As shown in FIG. 10, the groove 306 and the ring 308 are preferably sized so that the ring extends radially outwardly to between an outer circumferential surface 310 of the gear 36 and tips 312 of teeth 314 of the gear 36. In other words, a radial cross-section of the ring 308 is greater than a depth of the groove 306. The ring 308, therefore, prevents tips of teeth of the other gear 38 from contacting the outer circumferential surface 310 of gear 36 during meshed rotation of the gears.

A gear housing 40 supports the motor 42 and gears 36, 38. Preferably, the driven gear 38 is provided with index apertures 39 for receiving an index pin 50. The apertures 39 are positioned such that when the index pin 50 is inserted therein, proper positioning of a particular collimator slit 26 is ensured. In this manner, the motor 42 and the gears 36, 38 rotate the collimator 24 into general position, and the index pin 50 is engaged to fine tune the rotated position of the collimator and lock the collimator in position. To allow for the fine tuning, a taper 51 is provided on the tip of the index pin 50 to recover the apertures 39 of the driven gear 38 from slight misalignment before insertion of the pin 50. A shoulder bushing 52 is provided on the gear housing 40 to permit a slidable relationship between the index pin 50 and the housing 40. An index linkage 46, supported by pivot stud 48 is engaged by solenoid 44 for activating/deactivating the index pin 50. The solenoid 44 is preferably operated by the same controller as the selection motor 42 such that the solenoid is activated after operation of the motor so the index pin 50 fine tunes the position of the rotated collimator and locks the collimator in position, and deactivated before operation of the motor so the index pin releases the collimator. Alternatively, the drive gear 36 could be provided with the index apertures instead of the driven gear 38.

It should be understood that although the means for selecting 302 a collimator slit is described and illustrated as used with a rotating collimator 24, the presently disclosed means for selecting 302 can be adapted for use with a sliding collimator. In other words, a "slidable" collimator having a plurality of slits and curved about a common axis of curvature, but not curved along a longitudinal axis of the collimator such that the collimator is slide parallel with the axis of curvature (not rotated) to select a slit, can be provided. The slidable collimator is then mounted between the base 20 and the cover 34 of the assembly 300 for sliding movement relative to the base and the cover and parallel with the z-axis (instead of rotational movement). A chain for example, is secured to the collimator (in place of the driven gear 38), and meshed with the drive gear 36, such that operation of the selection motor 42 slides the collimator parallel with the z-axis and aligns a preferred collimator slit with the aperture 35 of the cover 34.

As mentioned above, the collimator assembly of FIG. 9 further includes means for shifting 304 the collimator 24 along the z-axis to compensate for shifting of a focal spot of a scanner incorporating the assembly 300 during operation of the scanner, due to thermal expansion and centrifugal force for example. To begin with, the base 20 supporting the collimator 24 is mounted so as to allow the base to be moved back and forth parallel with the z-axis.

In particular, the assembly 300 includes a stationary support 54 and stationary blocks 74 that are for mounting the assembly 300 within a scanner, adjacent to an x-ray source. The support 54 is arranged such that it is parallel to the x-axis of the scanner and parallel to the longitudinal axis 33 of the collimator mounting bracket 22. Bores 21 in the collimator base 20 slidingly receive elongated rods 72 that extend between the stationary support 54 and the stationary blocks 74. The elongated rods 72 are arranged such that they are parallel to the z-axis of the scanner and normal to the longitudinal axis 33 of the collimator mounting bracket 22. Each elongated rod 72 receives a slide bearing 68 that is concentric with, and interfaces with, an outer race 70 fixed within the bores 21 of the base 20 such that the base 20, and the collimator 24, can be slid on the elongated rods 72 between the stationary support 54 and the stationary blocks 74.

Figure 11:
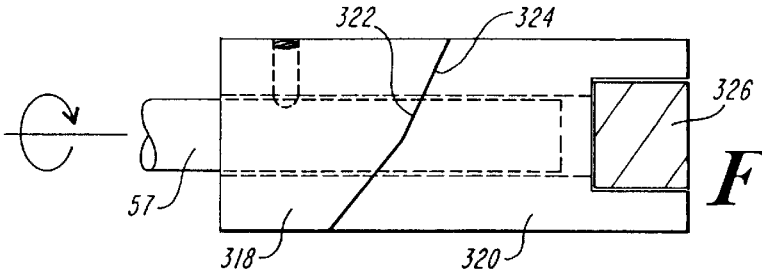
FIGS. 11, 12 and 13 are side elevation views of a cam mechanism according to the present disclosure for use as part of the collimator assembly of FIG. 9, wherein linear movement of one cam in response to rotary movement of another cam is progressively shown in the three figures.
Figure 12:
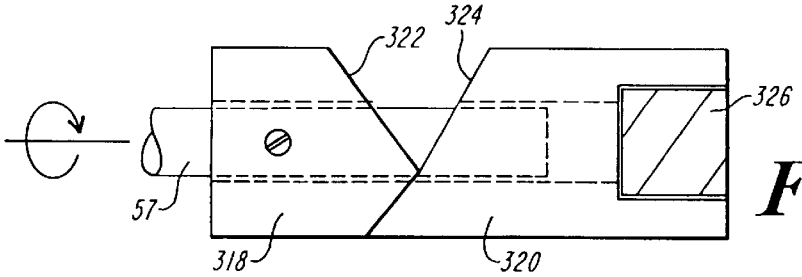
Figure 13:
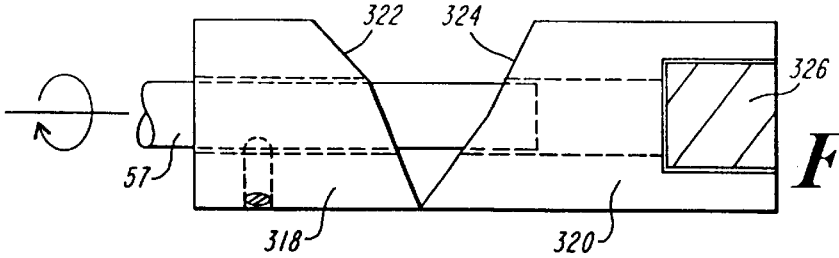

Referring also to FIGS. 11–13, the means for shifting 304 the collimator 24 preferably comprises an "alignment" motor 56 mounted to the stationary support and having a rotatable shaft 57, and a cam mechanism 316 for translating the rotational movement of the motor shaft 57 into sliding movement of the collimator 24 on the elongated rods 72 and parallel with the z-axis. The motor 56 is mounted via a mounting plate 58 to the stationary support 54 such that the motor shaft 57 extends though a bore 55 of the stationary support.

The cam mechanism 316 preferably comprises a rotatable cam 318 and a slidable cam follower 320. The rotatable cam 318 is fixed coaxial on the motor shaft 57 for rotation therewith, while the slidable cam follower 320 is received coaxial on the motor shaft 57 but not secured thereto, such that the motor shaft 57 can rotate and slide within the slidable cam follower 320. Whereby, when the alignment motor 56 is activated, a cam surface 322 of the rotatable cam 318 rotates with respect to a corresponding cam surface 324 of the slidable cam follower 320. The cam surfaces 322, 324 are shaped such that, as the rotatable cam 318 is rotated, the slidable cam follower 320 linearly slides on the motor shaft 57 between a fully retracted position as shown in FIG. 11, a partially extended position as shown in FIG. 12, and a fully extended position as shown in FIG. 13. A slide bearing 60 is provided between the bore 55 of the stationary support 54 and the cams 318, 320.

The slidable cam follower 320 is secured to a flexible push bar 326, which is secured at its ends to the stationary support 54 such that the push bar prevents rotation of the slidable cam follower. Referring in particular to FIG. 9, the push bar 326 includes protrusions 328 which extend toward the base 20 of the collimator 24. Flexible contact plates 330 are secured to the base 20 and have ends 332 that extend normal with respect to the z-axis and beyond the base 20 and receive the protrusions 328, such that the contact plates act as shock absorbers between the push bar 326 and the base 20.

Accordingly, as the rotatable cam 318 is rotated and causes the slidable cam follower 320 to move from the fully retracted position of FIG. 10 towards the fully extended position of FIG. 12, the slidable cam follower in turn causes the resilient push bar 326 to bow outwardly from the stationary support 54 towards the collimator base 20. As the push bar 326 is bowed outwardly, the protrusions 328 of the push bar push the contact plates 330 and the base 20 parallel to the z-axis and towards the stationary blocks 74. When the direction of rotation of the rotatable cam 318 is reversed (or continued), the collimator base 20 is allowed to be moved back against the push bar 326 so that the slidable cam follower 320 moves from the fully extended position of FIG. 12 to the fully retracted position of FIG. 10. The means for shifting 304 preferably also comprises springs 73 mounted in the bores 21 of the base 20 and engaging the outer races 70 to bias the base 20 towards the stationary support 54.

The alignment motor 56 preferably comprises a stepping motor controlled by a controller (not shown) having a counter. A focal spot position detector (not shown) provides signals to the controller indicative of focal spot shifting, so that the controller can operate the motor 56 to realign the collimator 24 with the focal spot. The controller is calibrated with respect to the signals from the focal spot position detector and calibrated with respect to the amount of shifting of the collimator 24 produced through the cam mechanism 316 by each stepped rotation of the motor shaft 57. The controller can calculate the position of the collimator 24 with respect to the focal spot based upon the number of stepped rotations of the shaft 57 and, if necessary, calculate the number of stepped rotations of the shaft 57 needed to realign the collimator 24 with the focal spot. Suitable controller and focal spot position detectors for use with the means for shifting 304 disclosed herein are shown, for example, in U.S. Pat. No. 5,550,886 to Dobbs et al., which has been incorporated herein by reference.

While this disclosure has been particularly shown and described with references to the collimators and collimator assemblies of FIGS. 3–12, it will be understood by those skilled in the art that various changes in form and in details may be made thereto without departing from the spirit and scope of the disclosure as defined by the appended claims. For example, while the presently disclosed collimators and collimator assemblies have been shown and described with particular reference to x-ray beams of computer tomography scanners, it is to be appreciated that the disclosure may find further application in other areas of radiography, such as medical diagnostic digital x-ray, conventional x-ray, radiation therapy, and the like.

What is claimed is:

1. A collimator for collimating a beam of energy emitted from a focal spot of a beam source, comprising:

a plurality of slits, each slit including, a uniform width varied from each of the widths of the remaining slits, and a curved side profile sharing a common axis of curvature so that each slit provides a cross-section of the emitted beam of energy with a substantially uniform width when the common axis of curvature substantially intersects the focal spot;

wherein the collimator is curved about a rotation axis substantially normal to the common axis of curvature, such that rotating the collimator about the rotation axis will sequentially position the slits to collimate the emitted beam.

2. A collimator assembly including a collimator according to claim 1 and further comprising means for selecting a slit by rotating the collimator about the rotation axis.

3. A collimator assembly according to claim 2, wherein the means for selecting comprises:

a selection motor having a rotatable shaft; and a gear mechanism coupling the motor shaft to the collimator for rotating the collimator about the rotation axis upon rotation of the shaft.

4. A collimator assembly according to claim 3, wherein the gear mechanism comprises:

a drive gear fixed to the shaft of the motor; and a driven gear fixed to the collimator and meshed with the drive gear.

5. A collimator assembly according to claim 4, wherein the gear mechanism further comprises means for absorbing shock between the meshed gears.

6. A collimator assembly according to claim 5, wherein the means for absorbing shock comprises resilient material seated in a circumferential groove of at least one of the gears.

7. A collimator assembly according to claim 6, wherein the resilient material is in the form of a continuous ring.

8. A collimator assembly according to claim 7, wherein a radial cross-section of the ring is greater than a depth of the groove so that the resilient ring extends radially outwardly from the groove to between a circumferential surface of the gear and tips of teeth of the gear to substantially prevent teeth of the other gear from contacting the circumferential surface.

9. A collimator assembly according to claim 4, wherein one of the drive and driven gears includes a plurality of apertures corresponding to the plurality of slits of the collimator and the assembly further comprises an index pin for insertion into the aperture corresponding to a selected slit for fine tuning the position of the collimator after selection of the slit.

10. A collimator assembly according to claim 9, wherein the index pin includes a tapered insertion tip.

11. A computer tomography scanner including a collimator assembly according to claim 3, and further including:

a beam source having a focal spot for emitting an x-ray beam through the collimator assembly;

a controller for actuating the selection motor of the collimator assembly; and an array of x-ray detectors for receiving the collimated x-ray beam from the collimator assembly.

12. A collimator assembly according to claim 2, further comprising means for shifting the collimator in a direction normal to the elongated slits of the collimator for alignment with a shifting focal spot of a beam source so that a selected slit of the collimator will collimate a beam of energy emitted from the focal spot.

13. A collimator assembly according to claim 12, wherein the means for shifting comprises:

an alignment motor having a rotatable shaft;

a cam mechanism for translating the rotation of the shaft into shifting of the collimator in a direction normal to the elongated slits of the collimator.

14. A collimator assembly according to claim 13, wherein the cam mechanism comprises:

a cam fixed to the motor shaft for rotation therewith; and a follower rotatably and slidingly received on the motor shaft and operatively contacting the cam for sliding movement of the follower on the shaft in response to rotation of the cam, said follower operatively arranged with respect to the collimator such that sliding movement of the follower on the shaft causes shifting of the collimator in a direction normal to the elongated slits of the collimator upon.

15. A collimator assembly according to claim 14, wherein the cam mechanism further includes:

at least one flexible contact plate secured to the collimator and having an end extending outwardly from the collimator parallel to the elongated slits of the collimator, and at least one protrusion extending from the follower for contacting the end of the contact plate.

16. A collimator assembly according to claim 13, wherein the means for shifting further comprises a spring biasing the collimator against the cam mechanism in a direction normal to the elongated slits of the collimator.

17. A computer tomography scanner including a collimator assembly according to claim 13, and further including:

a beam source having a focal spot for emitting an x-ray beam through the collimator assembly;

a detector for providing signals indicative of shifting of the focal spot;

a controller for receiving the signals from the detector and connected to the alignment motor of the collimator assembly for actuating the alignment motor upon shifting of the focal spot; and an array of x-ray detectors for receiving the collimated x-ray beam from the collimator assembly.

18. A collimator assembly comprising:

a collimator including a plurality of slits of varied widths for collimating a beam of energy emitted from a focal spot of a beam source, wherein moving the collimator in a predetermined manner sequentially positions the slits to collimate the emitted beam;

a gear coupled to the collimator and adapted to move the collimator in the predetermined manner upon being rotated, said gear including a circumferential groove;

a selection motor for rotating the gear; and resilient material received in the circumferential groove of the gear, wherein the gear includes a plurality of apertures corresponding to the plurality of slits of the collimator and the assembly further comprises an index pin for insertion into one of the apertures for fine tuning the position of the collimator after rotation of the gear.

19. A collimator assembly comprising:

a collimator including a plurality of slits of varied widths for collimating a beam of energy emitted from a focal spot of a beam source, wherein moving the collimator in a predetermined manner sequentially positions the slits to collimate the emitted beam;

a gear coupled to the collimator and adapted to move the collimator in the predetermined manner upon being rotated, said gear including a plurality of apertures corresponding to the plurality of slits of the collimator;

a motor for rotating the gear; and an index pin for insertion into one of the apertures for fine tuning the position of the collimator after rotation of the gear.

20. A collimator assembly according to claim 19, wherein the predetermined manner comprises rotating the collimator.

21. A computer tomography scanner including a collimator assembly according to claim 19, and further including:

a beam source having a focal spot for emitting an x-ray beam through the collimator assembly;

a controller for actuating the selection motor of the collimator assembly; and an array of x-ray detectors for receiving the collimated x-ray beam from the collimator assembly.

22. A collimator assembly comprising:

an alignment motor having a rotatable shaft;

a cam fixed to the motor shaft for rotation therewith;

a follower rotatably and slidingly received on the motor shaft and operatively contacting the cam for linear movement of the follower along the shaft upon rotation of the cam; and a collimator including at least one elongated slit for collimating a beam of energy emitted from a focal spot of a beam source, the collimator operatively arranged with respect to the follower for movement of the collimator in a direction normal to the elongated slit upon movement of the follower.

23. A collimator assembly according to claim 22, further comprising:

at least one flexible contact plate secured to the collimator and having an end extending outwardly from the collimator parallel to the elongated slit of the collimator, and at least one protrusion extending from the follower for contacting the end of the contact plate.

24. A collimator assembly according to claim 22, further comprising a spring biasing the collimator against the follower in a direction normal to the elongated slits of the collimator.

25. A computer tomography scanner including a collimator assembly according to claim 22, and further including:

a beam source having a focal spot for emitting an x-ray beam through the collimator assembly;

a detector for providing signals indicative of shifting of the focal spot;

a controller receiving the signals from the detector and connected to the alignment motor of the collimator assembly for actuating the alignment motor upon shifting of the focal spot; and an array of x-ray detectors for receiving the collimated x-ray beam from the collimator assembly.

* * * * *